US006688791B2

(12) United States Patent
Otsuki

(10) Patent No.: US 6,688,791 B2
(45) Date of Patent: Feb. 10, 2004

(54) ROLL PAPER PRINTING SYSTEM, METHOD FOR MANAGING REMAINING AMOUNT OF ROLL PAPER, RECORDING MEDIUM, ROLL PAPER WITH MEMORY

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/164,315

(22) Filed: Jun. 7, 2002

(65) Prior Publication Data

US 2002/0197091 A1 Dec. 26, 2002

(30) Foreign Application Priority Data

Jun. 8, 2001 (JP) ..... 2001-174044

(51) Int. Cl.[7] ..... B41J 29/18

(52) U.S. Cl. ..... 400/706; 400/703; 400/708; 400/621

(58) Field of Search ..... 400/706, 703, 400/708, 611, 613–613.2, 615.2, 618, 621; 242/563, 563.2

(56) References Cited

U.S. PATENT DOCUMENTS 4,535,949 A * 8/1985 Olsson ..... 242/534.2

FOREIGN PATENT DOCUMENTS

| | | | | |
|---|---|---|---|---|
| JP | 60-87158 | | 5/1985 | |
| JP | 63-154567 | | 6/1988 | |
| JP | 04176674 | A * | 6/1992 | ..... B41J/15/04 |
| JP | 09166937 | A * | 6/1997 | ..... G03G/21/00 |
| JP | 9-124184 | | 8/1997 | |
| JP | 10-226144 | | 1/1998 | |
| JP | 10254200 | A * | 9/1998 | ..... G03G/15/00 |
| JP | 2001139202 | A * | 5/2001 | ..... B65H/26/08 |
| JP | 2002337409 | A * | 11/2002 | ..... B41J/15/04 |
| WO | WO 96/14989 | | 5/1996 | |
| WO | WO 98/52762 | | 11/1998 | |

* cited by examiner

*Primary Examiner*—Andrew H. Hirshfeld
*Assistant Examiner*—Minh Chau
(74) *Attorney, Agent, or Firm*—Sughrue Mion, PLLC

(57) ABSTRACT

A roll-paper printing system comprises carry-amount detecting means, recording means, and updating means. The carry-amount detecting means detects a carried amount of the roll paper; the recording means records amount information regarding an amount of the roll paper; and the updating means makes the amount information be recorded on the recording means based on the carried amount detected by the carry-amount detecting means. The updating means makes the amount information be recorded on the recording means when a physical process for indicating a break in roll-paper usage is conducted to the roll paper.

23 Claims, 14 Drawing Sheets

STATE PULLED BACK TO INITIAL POSITION $$PL = Ls - L1 - Ph - L2 + L2 + L1$$

ROLL PAPER PRINTING SYSTEM, METHOD FOR MANAGING REMAINING AMOUNT OF ROLL PAPER, RECORDING MEDIUM, ROLL PAPER WITH MEMORY

BACKGROUND OF THE INVENTION

The present application claims priority upon Japanese Patent Application No. 2001-174044 filed on Jun. 8, 2001, which is herein incorporated by reference.

1. Field of the Invention

The present invention relates to a roll-paper printing system conducting printing on a roll paper, a method for managing a remaining amount of roll paper, a recording medium, and a roll paper with a memory. Particularly, the present invention relates to such as a roll-paper printing system which is capable of managing an amount of roll paper.

2. Description of the Related Art

A roll paper is made by winding, for a plurality of times, a continuous long printing paper to a surface of a core. In a printing system using a roll paper, printing is carried out by successively feeding the roll paper to a printing position in accordance with generation of a print image. When printing of 1 page is finished, the printed roll paper is fed a predetermined amount, is subjected to cutting or the like at a predetermined position, and then is discharged In a case where a printing system uses a cut sheet, an image for 1 page (or an image for a predetermined number of bands) is generated in accordance with the size of the cut paper, and the cut paper is supplied per unit of paper. Accordingly, in normal cases, a paper-out condition will not occur during printing of a certain page. In contrast, in a case where a printing system uses a roll paper, continuous long printing paper is supplied by predetermined amounts, and there is a possibility in that the size (particularly the size in the length direction) of a print image may respectively differ for each printing job. Thus, there is a possibility in that a shortage in a remaining amount of roll paper will occur, and printing will be interrupted.

Thus, there have been conventionally proposed various techniques to detect the remaining amount of roll paper. For example, in Japanese Patent Application Laid-open Publication No. 60-87158, Japanese Patent Application Laid-open Publication No. 63-154567, or the like, a remaining amount of roll paper is detected by detecting the rotation of the roll paper with a rotary encoder. Other than these, there are known methods such as a method wherein an extendable-and-retractable rod is pressed to the front surface or the back surface of a roll paper and a remaining amount of roll paper is detected by the amount of movement of the rod (such as Japanese Patent Application Laid-open Publication No. 9-124184), a method of detecting a remaining amount of roll paper by optically detecting a mark provided on a non-print region of the roll paper with a sensor (Japanese Patent Application Laid-open Publication No. 10-226144), a method of detecting a remaining amount of roll paper by determining the amount of roll paper used by adding up the number of print columns.

Further, as a conventional technique relating to management of a remaining amount of roll paper, there is known, for example, a technique in which a remaining amount of each roll paper is respectively stored to a memory of a printer, and the remaining amount of roll paper within the memory is updated according to the amount of roll paper used, as described in Japanese Patent Application Laid-open Publication No. 10-25046.

In contrast to a cut sheet, it is not possible to appropriately supplement printing paper in the case of a roll paper. In a case where a printing system uses a cut sheet, the information regarding "remaining amount of paper" is an attribute of a paper-supplying cassette. However, in the case of a roll paper, since this is a continuous long printing paper, the information regarding a remaining amount of paper becomes attribute information for the roll paper. Therefore, as with the conventional technique described in Japanese Patent Application Laid-open Publication No. 10-25046, in the case of managing the remaining amount of each roll paper on the printer side, it will only be possible to use the roll paper with the printer to which the remaining amount is stored. That is, there is a problem in that a roll paper having been partially used cannot be used with another printer.

Further, apart from a case in which one roll of roll paper is used up upon one continuous printing, usually, a roll paper is partially used for a plurality of times of printing. Thus, in order to manage the remaining amount of roll paper, it is necessary to use a storage device which is capable of holding data until the next time of printing, and in which the data is erasable. As for such a storage device, it is possible to name, for example, a memory such as an EEPROM (Electrically Erasable Programmable ROM). In case of a memory such as an EEPROM, since the number of erasable times is as few as approximately ten thousand times, there is fear in that the memory will become unusable before the roll paper is used up, if, for example, the remaining amount thereof is minutely updated per every printing pass or per every raster. If a memory having a large number of erasable times is adopted, the cost of the memory-attached roll paper will increase. Further, if the remaining amount is minutely updated per every printing pass (every time the paper is fed), there is fear in that the load of a computer for the printer will increase and the processing speed will drop, as memory contents is frequently erased.

Thus, there may be considered a method of updating the remaining amount per a plurality of passes, and not updating the remaining amount per every printing pass. However, if updating is carried out by detecting a remaining amount of roll paper during printing, such an updating will often be useless. This is because the remaining amount detected during printing is a value obtained before a final remaining amount of roll paper is determined.

SUMMARY OF THE INVENTION

The present invention has been contrived in view of the above-mentioned problems, and an object thereof is to provide a roll-paper printing system capable of appropriately managing a remaining amount of roll paper. Another object of the present invention is to provide a roll-paper printing system capable of efficiently managing an amount of a roll paper by updating amount information, regarding an amount of a roll paper, at an appropriate timing. Further, another object of the present invention is to provide a roll-paper printing system capable of efficiently managing a remaining amount of roll paper by updating a remaining amount of roll paper at an appropriate timing.

A main roll-paper printing system for solving the above-mentioned problems comprises: carry-amount detecting means for detecting a carried amount of said roll paper; recording means for recording amount information regarding an amount of said roll paper; and updating means which makes said amount information be recorded on said recording means based on the carried amount detected by said carry-amount detecting means, said updating means making said amount information be recorded on said recording means when a physical process for indicating a break in roll-paper usage is conducted to said roll paper. Further, in another main roll-paper printing system, the remaining-amount recording means is provided on the roll paper; and the carry-amount detecting means which detects a carried amount of the roll paper, the remaining-amount detecting means which detects a remaining amount of roll paper based on the detected carried amount of roll paper and an initial remaining amount of the roll paper, and the remaining-amount updating means which makes the remaining amount of roll paper detected by the remaining-amount detecting means be recorded on the remaining-amount recording means are provided on the machine (the printer).

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 2A is a diagram showing an initial state; FIG. 2B is a diagram showing a state carried to a printing-start position; and FIG. 2C is a diagram showing a carried state of when printing is finished;

FIG. 3A is a diagram showing a state carried to a cutting position; FIG. 3B is a diagram showing a state pulled back to the printing position; and FIG. 3C is a diagram showing a state pulled back to the initial position;

FIG. 7A is a diagram showing an initial state; FIG. 7B is a diagram showing a carried state of when printing is finished; and FIG. 7C is a diagram showing a state carried to a cutting position.

DESCRIPTION OF PREFERRED EMBODIMENTS

Figure 1:
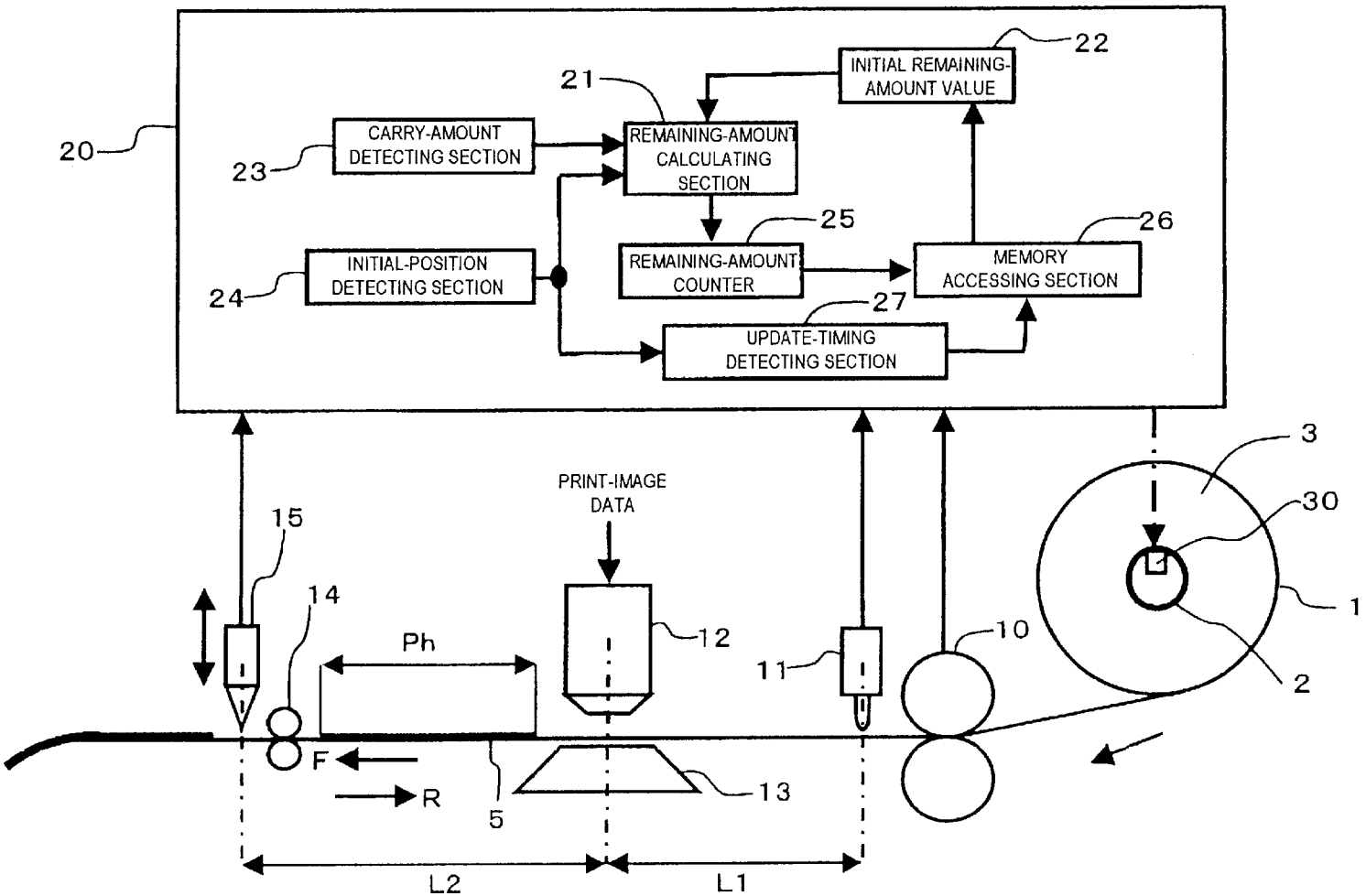
FIG. 1 is an explanatory diagram schematically showing principal portions of a roll-paper printing system used in the present embodiment.

At least the following matters will be made clear by the explanation in the present specification and the description of the accompanying drawings.

In a roll-paper printing system conducting printing on a roll paper, there are comprised: carry-amount detecting means which detects a carried amount of said roll paper; remaining-amount detecting means which detects a remaining amount of roll paper based on said carried amount of roll paper detected and an initial remaining amount of said roll paper; remaining-amount recording means provided on said roll paper for recording said remaining amount of roll paper detected; and remaining-amount updating means which makes said remaining amount of roll paper detected by said remaining-amount detecting means be recorded on said remaining-amount recording means, said remaining-amount updating means making said remaining amount of roll paper detected be recorded on said remaining-amount recording means when a physical process for indicating a break in roll-paper usage is conducted to said roll paper.

According to the above roll-paper printing system, the remaining-amount updating means is made to record the detected remaining amount of roll paper on the remaining-amount recording means when a physical process for indicating a break in roll-paper usage is conducted to the roll paper. Upon next printing, a value recorded on the remaining-amount recording means is read out as the initial remaining amount.

Here, as for a "physical process indicating a break in roll-paper usage", it is possible to name, for example, a cutting process of cutting a roll paper, a perforation process of making perforations in a roll paper, and a folding process of putting a fold in a roll paper. Note that the above can be rephrased as a "break upon printing", since usually, a process such as cutting is carried out each time a printing is completed on a page-to-page basis.

Since the remaining amount of roll paper of the remaining-amount recording means is made to be updated after a predetermined physical process has been carried out, it is possible to decrease the updating frequency than in the case where the remaining amount of roll paper is updated per each printing pass, and thus, it is possible to increase the longevity of the remaining-amount recording means. Further, since the updating frequency is decreased, it is possible to reduce the computer load and prevent decrease in data-processing speed. Furthermore, since the remaining-amount recording means is provided on the roll paper, it is possible to easily manage the remaining amount for each roll paper.

Further, the remaining-amount updating means may be structured to make the detected remaining amount of roll paper be recorded on the remaining-amount recording means when a leading edge of the roll paper is returned to a previously-set predetermined initial position after the physical process has been conducted.

Here, as for the predetermined initial position, it is possible to adopt, for example, a reference detecting position of a paper-detecting means for detecting a leading edge of paper, or, a reference printing position of a printing means for conducting printing on the roll paper.

By taking a time at which the leading edge of the roll paper is sent from the initial position as a starting point for detecting the remaining amount, and a time at which the leading edge of the roll paper is again returned to the initial position after the predetermined physical process as an endpoint, it is possible to obtain a precise remaining amount of roll paper.

Further, the remaining-amount updating means may be structured to make the detected remaining amount of roll paper be recorded on the remaining-amount recording means even before the physical process is conducted in case a printing error occurs.

As for printing errors, it is possible to list, for example, power shutdown, a miss in transferring print data (such as under-run error), jamming of paper, or the like. When such a printing error occurs, the remaining amount of roll paper is determined and the contents of the remaining-amount recording means is updated before the physical process is conducted and the paper is returned to the initial position. Accordingly, it is possible to manage the remaining amount of roll paper even when an error occurs during printing, and provide for when printing is resumed.

Further, according to another viewpoint, this may be grasped as a method for managing a remaining amount of roll paper.

That is, in the method for managing a remaining amount of roll paper, a carried amount is detected according to carrying of said roll paper from when a leading edge of said roll paper passes a predetermined initial position; a remaining amount of roll paper is made to be detected based on the carried amount when said leading edge of the roll paper is returned to said initial position after a physical process for indicating a break in roll-paper usage is conducted to said roll paper; and said determined remaining amount of roll paper is made to be recorded on said remaining-amount recording means.

Further, according to another viewpoint, this may be grasped as a roll-paper remaining-amount management program. This program can be allowed to be downloaded to a computer connected to the printing system through a communication line such as the Internet; or, recorded on and distributed as a recording medium Various kinds of recording media, such as a CD-ROM, a DVD-ROM, a magneto-optic disk, a hard disk, a memory, and the like, can be used as the recording medium.

Further, according to another viewpoint, the remaining-amount updating means makes the remaining amount of roll paper be updated at a predetermined timing, and not conducting updating of the remaining amount of roll paper each time paper is fed upon carrying of said roll paper.

Further, according to another viewpoint, this may be grasped as a roll paper with a memory which, when a physical process for indicating a break in roll-paper usage is conducted by a roll-paper printing apparatus, a remaining-amount value recorded on the remaining-amount recording means is updated by a remaining-amount updating means provided on the roll-paper printing apparatus.

Further, according to another viewpoint, a roll-paper printing system conducting printing on a roll paper comprises carry-amount detecting means, recording means, and updating means. The carry-amount detecting means detects a carried amount of said roll paper; the recording means records amount information regarding an amount of said roll paper; and the updating means makes said amount information be recorded on said recording means based on the carried amount detected by said carry-amount detecting means. Further, the updating means makes said amount information be recorded on said recording means when a physical process for indicating a break in roll-paper usage is conducted to said roll paper.

Below, an embodiment of the present invention will be explained in detail with reference to the drawings.

FIG. 1–FIG. 4 relate to a first embodiment of the present invention, wherein FIG. 1 is a structural explanation diagram schematically showing main parts of a roll-paper printing system according to the present embodiment.

A roll paper 1 is, for example, made by winding, for a plurality of times, a continuous long printing paper 3 to an outer peripheral surface of a cylindrical core 2. The roll paper 1 is provided in beforehand with a recording device 30 for recording data relating to itself. The recording device 30 as a "remaining-amount recording means" or a "recording means" may, for example, be detachably or fixedly provided on an inner peripheral surface of the core 2. Alternatively, in a case where flanges are formed on both ends of the core 2, it is possible to provide the recording device 30 on these flanges. In case the recording device 30 is provided at an intermediate portion in the axial direction of the core 2 on the inner peripheral surface thereof, a communication distance with the printer will increase.

Here, the recording device 30 may be structured to comprise, for example, a non-volatile erasable memory such as an EEPROM, a power-supply section which supplies power to the memory, and a communicating section for carrying out communication with the printer. For example, it is possible for the recording device 30 to receive a radio wave (including data relating to a remaining amount) sent from the printer, generate an induced electromotive force with this radio wave, and use this as a power source. Note that various methods not limited to the above can be adopted. For example, it is possible to form a connecting point for data transmitting/receiving and power supply at an end of the core 2, contact the point with a connecting point on the printer, and upgrade the contents of the memory. That is, the recording device 30 and a memory accessing section 26 can carry out transmitting/receiving of data according to either a contact-type or non-contact-type method. Note that on paragraph numbers 0030–0032 or the like of Japanese Patent Application No. 2000-397634 formerly filed by the present applicant describes a specific example regarding a non-contact type, and on paragraph numbers 0054, 0055 or the like of the same describes a specific example regarding a contact type. These explanations and the drawings to which the explanations refer are referred to in the present application as necessary.

The roll paper 1 is set by a user on a predetermined position of a printer body. Alternatively, there may be cases where the roll paper 1 is set within a supplying device which is made independently of the printer body and which can supply a plurality of roll papers. The roll paper 1 is carried in the direction of arrow F by a paper-feed roller 10. A paper-detecting sensor 11 provided in the vicinity of the paper-feed roller 10 detects the leading edge of the roll paper. When the roll paper 1 is carried to a print head 12, predetermined printing is started according to print-image data. Reference number 13 shows, for example, a supporting member such as a platen for supporting the roll paper from its back side. Note that, although the figure shows an ink-jet print engine, the present invention is not limited thereto. For example, there may be cases where a laser printer is adopted, and in this case, a transfer roller, for example, is used instead of the print head 12.

By passing the print head 12, a printed page 5 is formed at a predetermined position of the roll paper 1. The length of the page 5 will be hereinafter referred to as Ph. The page length Ph includes the print image and the margins formed on both sides of the image in the carrying direction. The roll paper 1 is discharged by a paper-discharge roller 14. In the vicinity of the paper-discharge roller 14, there is provided a cutter 15 which is an example of the "physical process indicating a break in roll-paper usage". The printed page 5 is cut off from the roll paper 1 by the cutter 15, and is discharged to the discharge port. After cutting, the carrying direction of the roll paper 1 is reversed to the direction of arrow R, and the paper is drawn back to a position at which the leading edge is detected by the paper-edge detecting sensor 11.

A printer controller 20 is configured as a microcomputer system, and computer resources such as CPUs, RAMs, ROMs, I/O interfaces can appropriately be used. The printer controller 20 generates a print image according to print data received from a host computer such as a personal computer, and controls such as the carrying of the roll paper 1 and/or drive of the print head 12.

As will be described below, respective functions configuring the remaining-amount managing device are realized in the printer controller 20.

A remaining-amount calculating section 21, as a "remaining-amount detecting means", calculates the remaining amount of roll paper whenever necessary. The remaining-amount calculating section 21 detects the remaining amount of roll paper according to an initial remaining-amount value 22 and the amount of roll paper 1 carried which is detected by a carry-amount detecting section 23. The initial remaining-amount value 22 is a value read out from the recording device 30 provided on the roll paper 1. The carry-amount detecting section 23, as a "carry-amount detecting means", is made to, for example, detect a rotation amount and a rotating direction of a paper-feed motor which drives the paper-feed roller 10 by using a rotation detecting sensor such as an encoder, and detect the amount of roll paper 1 carried according to the rotation amount. Note that an output signal from the carry-amount detecting section 23 is of opposite sign when the roll paper 1 is carried in the direction of arrow F and when it is reversedly carried in the direction of arrow R.

The remaining-amount calculating section 21 may calculate, on an almost real-time basis and per a unit paper-feed amount, the remaining amount of roll paper during printing by adding or subtracting the carried amount to/from the initial remaining-amount value 22. The calculated remaining amount of roll paper is stored to a remaining-amount counter 25.

An initial-position detecting section 24 is for setting a timing to start monitoring of the remaining amount by the remaining-amount calculating section 21, and is made so that monitoring of the remaining amount by the remaining-amount calculating section 21 is started when the leading edge of the roll paper 1 is detected by the paper-detecting sensor 11. That is, in the present embodiment, a state in which the roll paper 1 is set to the printer and its leading edge is inserted to the detecting position of the paper-detecting sensor 11 is taken as an initial state. Specifically, for example, a configuration is made possible in which the carried amount is not detected by carry-amount detecting section 23, or is neglected by the remaining-amount calculating section 21, until the paper-detecting sensor 11 detects the roll paper 1. Further, a configuration is made possible in which, when the roll paper 1 is being carried in the direction of arrow F and the paper-detecting sensor 11 detects the roll paper 1, a reset signal is input to the remaining-amount counter 25.

The memory-accessing section 26 is such which reads out the remaining amount of roll paper held by the remaining-amount counter 25 according to a signal from an update-timing detecting section 27, and sends this data to the recording device 30 to make the remaining amount of roll paper be updated. The memory-accessing section 26 configures, together with the update-timing detecting section 27, a "remaining-amount updating means" or "updating means". The update-timing detecting section 27 detects when the roll paper 1 is cut by the cutter 15 and pulled back to the reference detecting position of the paper-detecting sensor 11, which is the initial position, as a timing for updating the remaining amount of roll paper.

Next, the relation between the carried state of the roll paper 1 and the remaining-amount value held by the remaining-amount counter 25 will be explained with reference to FIG. 2 and FIG. 3. Exemplified is a case in which printing of one page onto the roll paper 1 and cutting thereof is carried out.

Figure 2A:
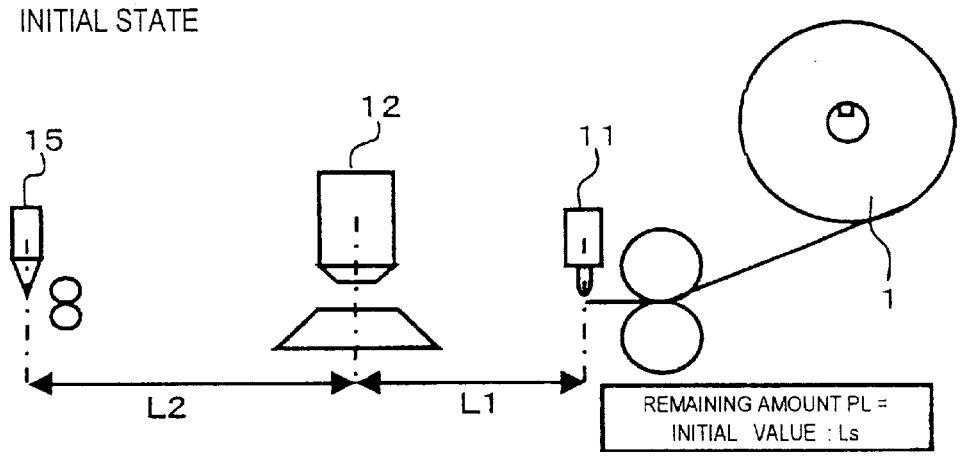
FIG. 2A, FIG. 2B, and FIG. 2C are schematic diagrams showing states in which the remaining amount of roll paper PL that a remaining-amount counter indicates changes according to a carried state of the roll paper.

Firstly, an initial state is shown in FIG. 2A. A state in which the leading edge of the roll paper 1 is carried to a position detected by the paper-detecting sensor 11 is taken as an initial state. At this time, a value of the remaining amount of roll paper (PL) that the remaining-amount counter 25 indicates is equal to an initial remaining-amount value Ls (PL=Ls). The initial remaining-amount value Ls is a remaining-amount value read out from the recording device 30 of the roll paper 1. L1 is the distance from the reference detecting position of the paper-detecting sensor 11, which is the initial position, to a reference printing position of the print head 12, and L2 is the distance from the reference printing position of the print head 12 to a cutting position of the cutter 15.

Figure 2B:
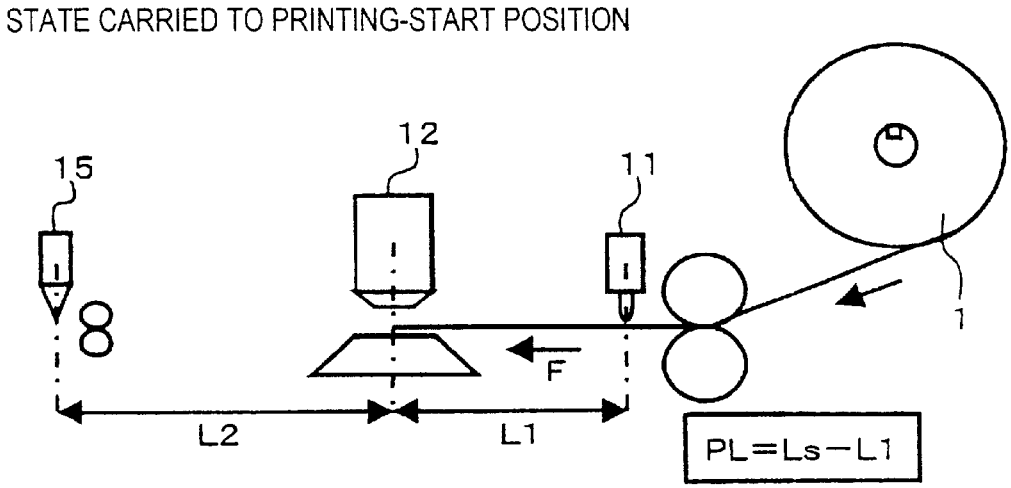

As shown in FIG. 2B, when printing is started, the roll paper 1 is carried in the direction of arrow F, and its leading edge reaches the print head 12. At this time, the remaining-amount value PL that the remaining-amount counter 25 indicates becomes a value in which the length L1, which is from the initial value to the reference printing position, is subtracted from the initial remaining-amount value Ls (PL=Ls−L1). Then, printing is carried out while the roll paper 1 is fed by a predetermined amount. Each time the roll paper 1 is fed, the value of the remaining-amount counter 25 decreases by the paper-feed amount.

Figure 2C:
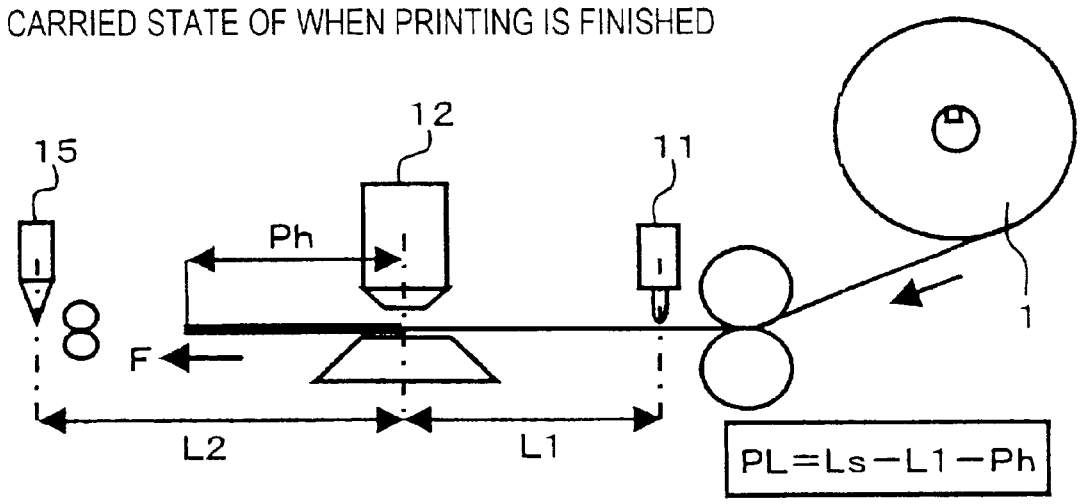

FIG. 2C shows a state in which printing of 1 page is finished. When the length of 1 page, including margins on both upper and lower ends, is indicated as Ph, the remaining amount PL that the remaining-amount counter 25 indicates right after finish of printing is PL=Ls−L1−Ph.

Figure 3A:
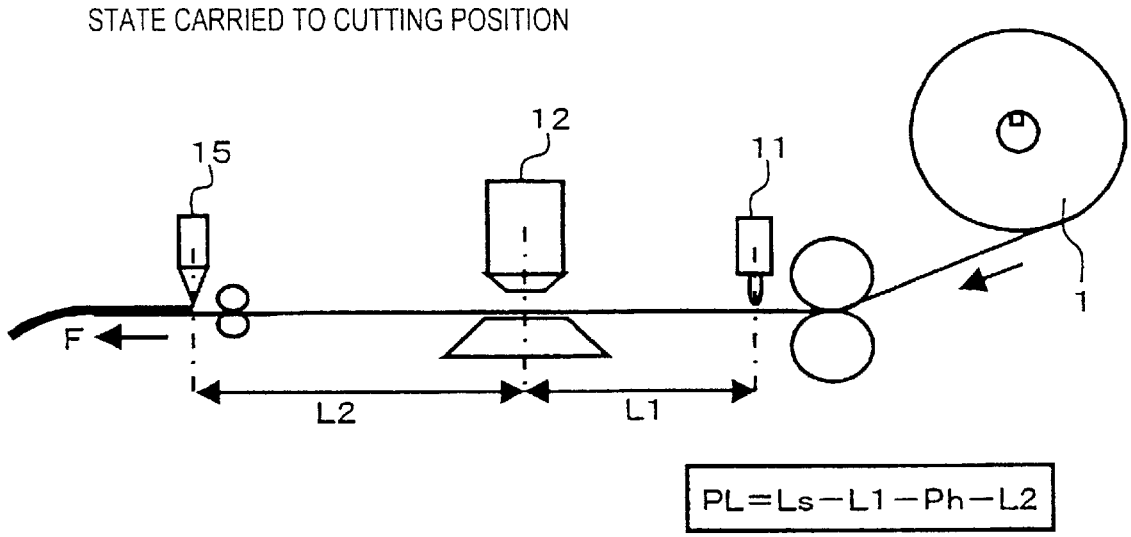
FIG. 3A, FIG. 3B, and FIG. 3C are schematic diagrams that follow FIGS. A–C.

As shown in FIG. 3A, the page in which printing is finished is carried to the position of the cutter 15, and is cut by the cutter 15 at a predetermined position. Therefore, the roll paper 1 is carried a further distance L2; and the remaining-amount value PL that the remaining-amount counter 25 indicates becomes PL=Ls−L1−Ph−L2. That is, an amount in which the roll paper 1 was fed while carrying out printing of 1 page to the roll paper 1 and cutting thereof becomes (L1+Ph+L2).

After cutting is finished, the roll paper 1 is returned to the initial position to provide for a new printing operation. For example, the leading edge of the roll paper 1 is pulled back towards the initial position by reversedly rotating the paper-feed roller 10.

Figure 3B:
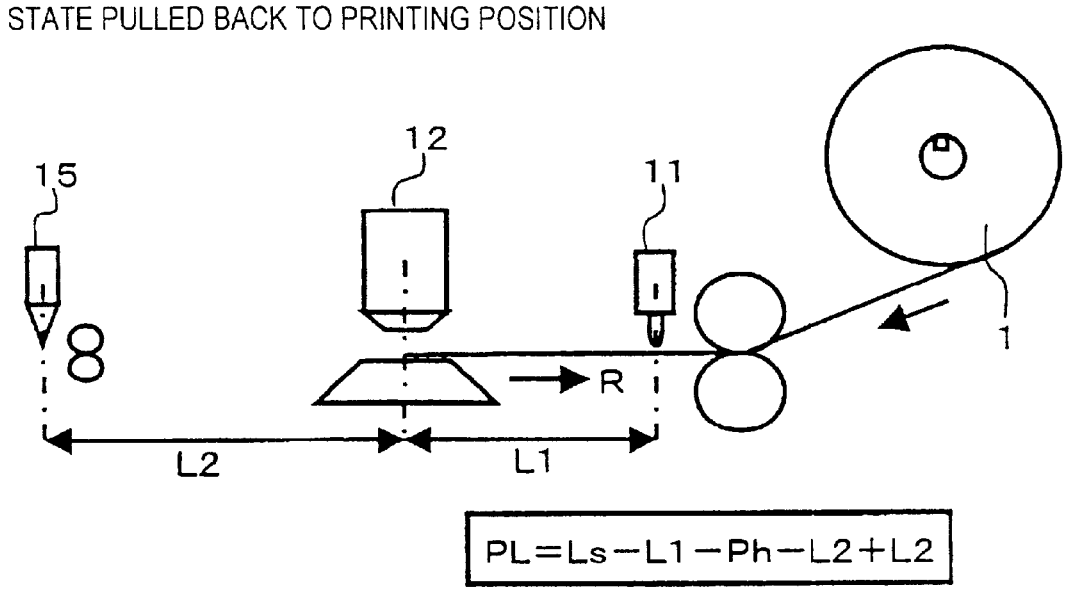

The state shown in FIG. 3B shows a state in which the leading edge of the roll paper 1 is pulled back, by the distance L2, from the cutting position of the cutter 15 to the reference printing position of the print head 12. Thus, the value of remaining amount PL that the remaining-amount counter 25 indicates becomes PL=Ls−L1−Ph−L2+L2=Ls−L1−Ph.

Figure 3C:
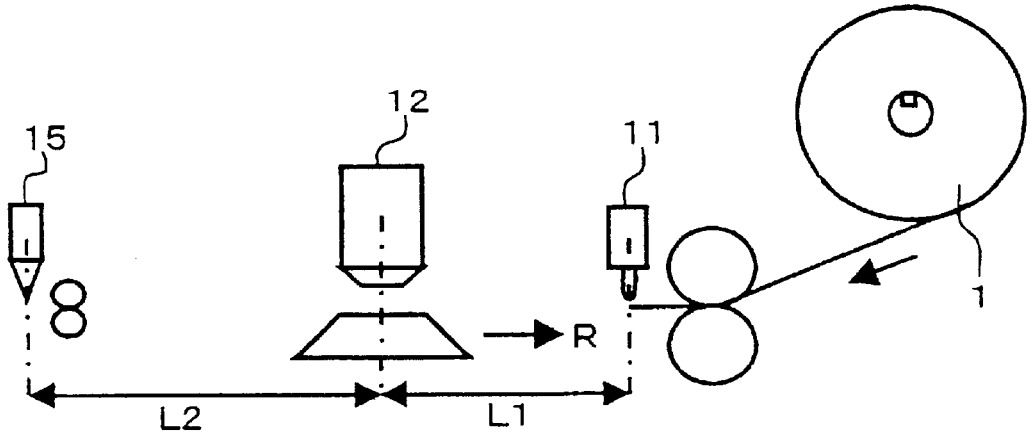

The state shown in FIG. 3C shows a state in which the leading edge of the roll paper 1 is pulled back, by a further distance L1, to the initial position detected by the paper-detecting sensor 11. At this time, the value of remaining amount PL that the remaining-amount counter 25 indicates becomes PL=Ls−L1−Ph−L2+L2+L1=Ls−Ph. Therefore, the amount obtained by subtracting the length Ph used for printing from the initial remaining-amount value Ls is determined as the remaining amount of roll paper 1. Thus, among the remaining amount of roll paper measured by the remaining-amount counter 25 on an almost real-time basis, the remaining amount PL of when the roll paper is returned to the initial position is transmitted to the recording device 30, and is updated.

During the period of from before printing is started until printing is finished and the leading edge of the paper roll 1 is returned to the initial position, the remaining amount of roll paper PL changes according to carrying of the roll paper 1, as indicated as PL=LS−L1−Ph−L2+L2+L1. If this is rewritten according to the types of change, it becomes PL=Ls−(L1+Ph+L2)+(L2+L1). The first term of the right side is the initial remaining-amount value Ls which indicates the remaining amount of roll paper before printing is started, i.e., the state right before the paper is carried. The second term of the right side, (L1+Ph+L2), indicates a total feed amount in which the roll paper 1 was delivered during the period until cutting, which is the physical process indicating a break in roll-paper usage, is carried out. The third term of the right side, (L2+L1), indicates a pulled-back amount in which the roll paper 1 is pulled back to the initial position after cutting is finished.

Note that FIG. 2 and FIG. 3 exemplify cases where cutting is carried out after printing of 1 page. However, as shown in a flowchart explained later, there are cases where a plurality of pages are continuously printed.

Figure 4:
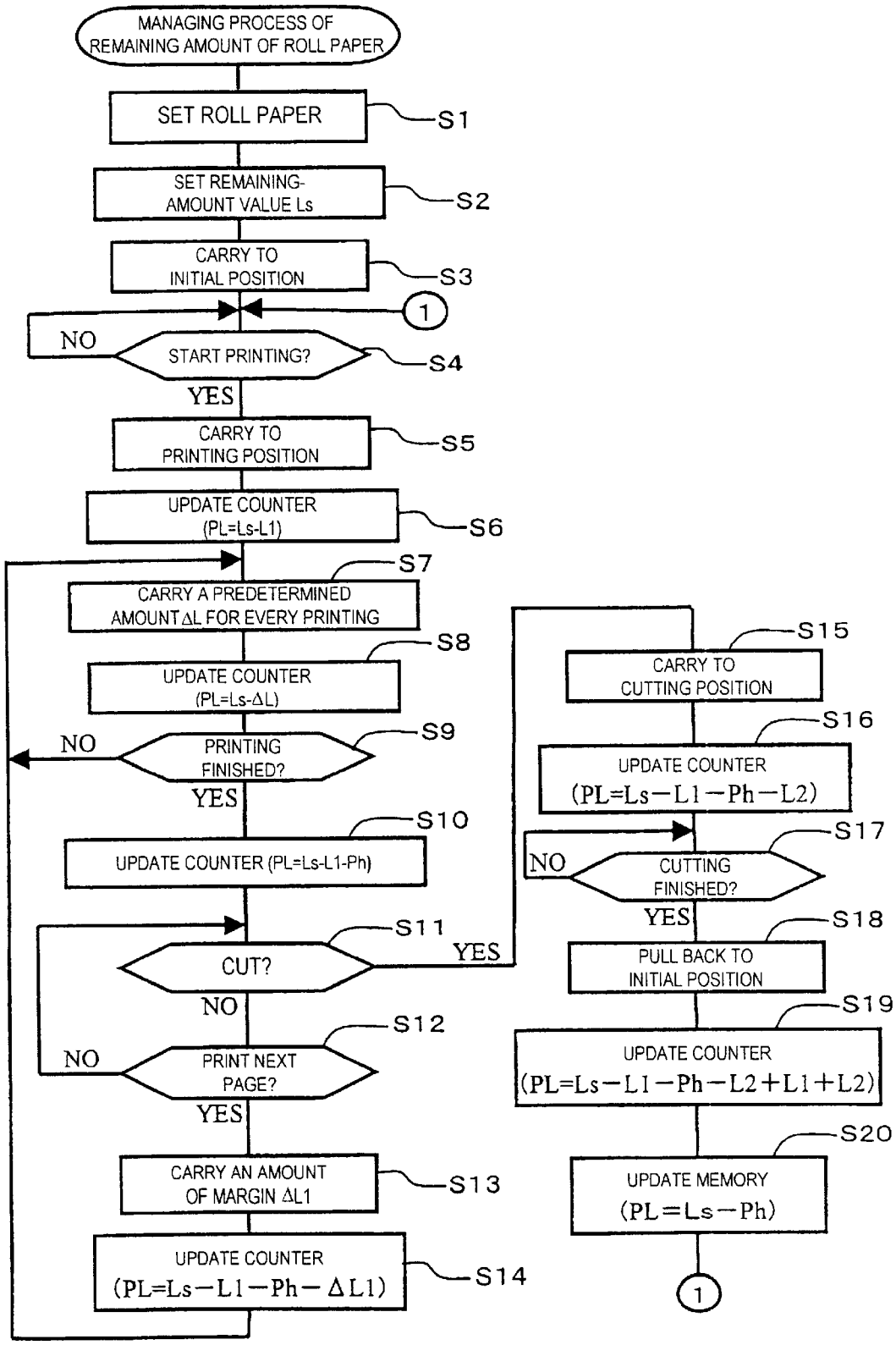
FIG. 4 is a flowchart showing a method for managing a remaining amount of roll paper.

Next, a method of managing the remaining amount of roll paper will be explained according to FIG. 4. In the explanation below, "step" will be abbreviated as "S".

Firstly, the user sets the roll paper 1 to a predetermined location of the printer (S1). If a roll paper 1 is already set to the printer, S1 is skipped. Next, the memory accessing section 26 accesses the recording device 30 on the roll paper 1, and reads out the remaining-amount value recorded on the recording device 30. The remaining-amount value Ls read out from the recording device 30 is set to the initial remaining-amount value 22 (S2), whereby the initial remaining-amount value 22 becomes LS.

Next, the leading edge of the roll paper 1 is carried to the initial position (the reference detecting position of the paper-detecting sensor 11) (S3). When printing is started (S4: YES), the roll paper 1 is carried towards the printing head 12 (S5). The remaining-amount calculating section 21 calculates the remaining amount of roll paper according to this carrying, and the calculated remaining amount of roll paper is stored in the remaining-amount counter 25 (S6).

In a printing process, a print image is produced by the print head 12 on a predetermined position on the roll paper 1 while carrying the roll paper 1 by a predetermined amount ΔL (S7). The remaining amount of roll paper changes according to the carrying of the roll paper 1, and the value on the remaining-amount counter gradually decreases (S8). It is to be noted that in S8, although it is indicated as if the remaining amount of roll paper PL decrements only once by the paper-feed amount ΔL for convenience of explanation, the remaining amount of roll paper that the remaining-amount counter 25 indicates will decrease by ΔL each time the paper is fed.

When printing is finished (S9: YES), an image for 1 page is produced on a printing surface of the roll paper 1. Accordingly, at the time printing is finished, the remaining amount of roll paper PL is decreased by the length of the printed page Ph (=ΔL×α: equal to the length in which a paper feed of ΔL is repeated for a predetermined number of α times) (S10).

Next, a decision is made of whether the printed page is to be cut or not (S11). It is possible to specify whether or not to cut the roll paper 1 in beforehand at the time of executing printing, or, the user can make a selection each time printing of each page is finished.

If cutting is not to be carried out (S11: NO), the printer will be on standby until printing of a next page is started (S12). When a print job for the next page is, for example, input to the printer and printing of the next page is started (S12: YES), the roll paper 1 is carried an amount of the margin ΔL1 in order to form a predetermined blank space between the end of the former page and the head of the next page (S13). Accordingly, the value of the remaining-amount counter 25 is updated (S14). After this, the processes of S7–S10 are repeated until printing of the next page is finished.

If the roll paper 1 is to be cut (S11: YES), the roll paper 1 is further carried to the cutting position by the cutter 15 (S15). The remaining amount of roll paper PL that the remaining-amount counter 25 indicates decreases by this carried amount (L2) (S16).

Then, a decision is made whether cutting is finished or not (S17). If cutting is finished, the leading edge of the roll paper 1 is pulled back to the position of the paper-detecting sensor 11, which is the initial position. Accordingly, the value of the remaining-amount counter 25 changes (S19), and the value of the remaining-amount counter 25 of when the roll paper 1 returns to the initial position is taken as a determined value and recorded contents (remaining amount of roll paper) of the recording device 30 is updated. Note that it is possible to detect whether cutting is finished or not by a sensor or by an input of an instruction by the user stating that cutting has finished.

As described above, according to the present embodiment, since the remaining amount of roll paper recorded on the recording device 30 is updated by determining the usage amount of the roll paper 1 when the roll paper 1 is cut, it is possible to update the remaining amount of roll paper at an appropriate timing, and it is possible to decrease the updating frequency. Accordingly, the recorded contents of the recording device 30 are not needlessly updated, and longevity of the memory can be increased. Further, it is possible to lessen the load imparted to a computer of the printer.

Further, because of the structure in which the recording device 30 is provided on the roll paper 1, the remaining amounts of each of the roll papers 1 can be managed thereby respectively, and the usability is enhanced compared to conventional art in which the remaining amount of roll paper is managed by the printer.

Particularly, in a case where the initial position (the reference detecting position of the paper-detecting sensor 11) is provided upstream in the carrying direction (upstream in the paper-feed direction) from the cutting position for carrying out the physical process to the roll paper 1, there is a need to pull back the roll paper 1 after cutting, and the value of the remaining-amount counter 25 increases by pulling the roll paper 1 back. Accordingly, if the remaining amount of roll paper of the recording device 30 is updated before cutting, such an updating will be useless since the updating will only reflect an intermediate result. On the contrary, in the present embodiment, the recorded contents of the recording device 30 is updated when the usage amount of the roll paper 1 is determined upon cutting.

In other words, in a case of a roll paper which may be pulled back, there is a need to link the timing of determining the usage amount of the roll paper and the timing of updating the remaining amount. In case of expendable items such as cut sheets and/or ink cartridges, the remaining amount is decreased by the amount used, and there is no case in which the remaining-amount value will increase; thus, the usage amount and the remaining amount always correspond. Therefore, there is no need to consider harmonization of the timing of determining the usage amount and the timing of updating the remaining amount. However, as in the present embodiment, in a case of a printing system where pulling back (rewinding) may occur after completion of a printing process, there is a need to update the remaining amount after waiting for the usage amount to be determined.

Thus, in the present embodiment, the remaining amount on the recording device 30 is updated regarding that the usage amount of the roll paper is determined when the roll paper 1 is cut and a break upon usage is indicated, to thus prevent needless updating of the remaining amount.

Figure 5:
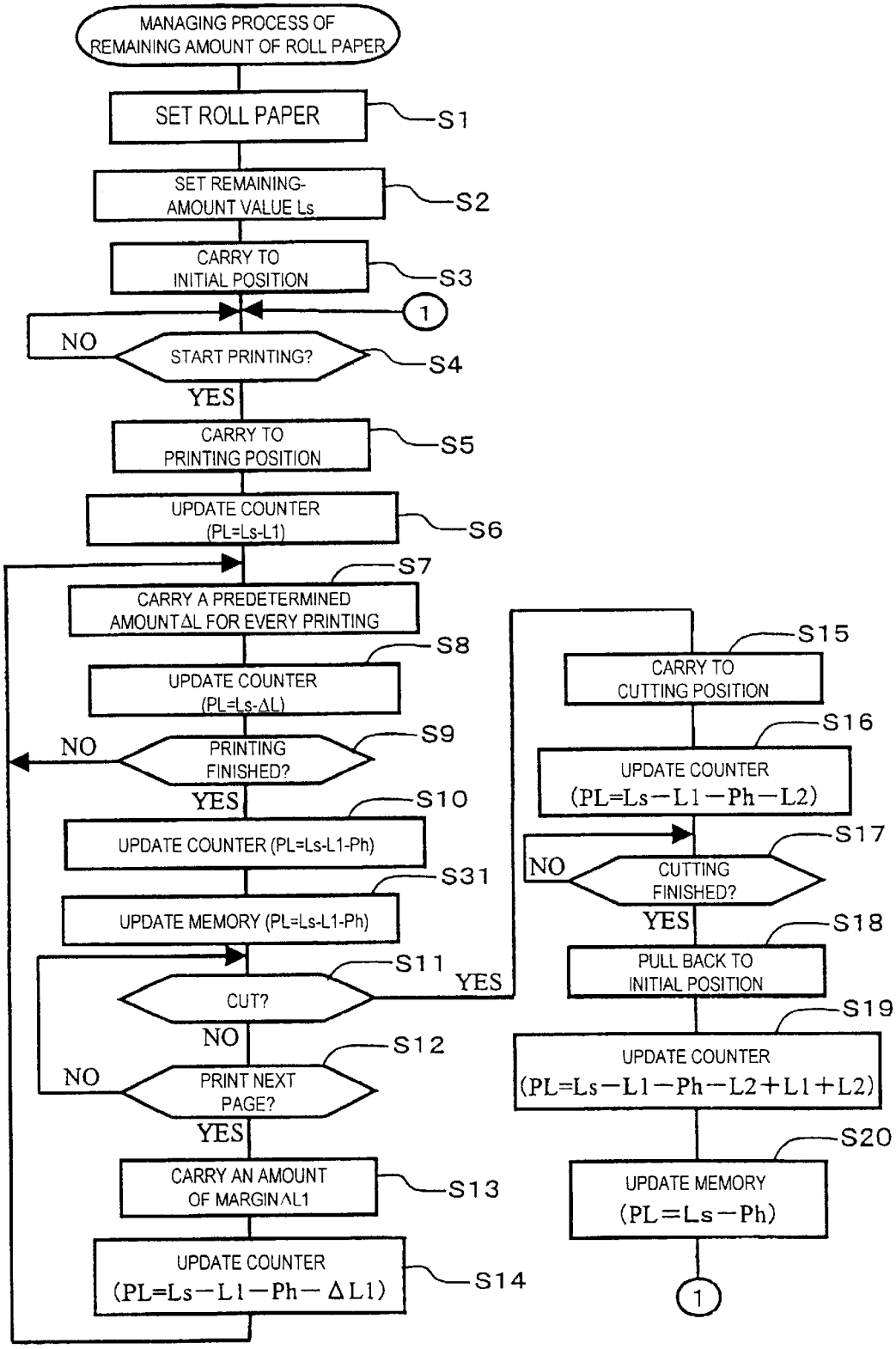
FIG. 5 is a flowchart showing a method for managing a remaining amount of roll paper according to a second embodiment of the present invention.

Next, a second embodiment of the present invention will be explained according to FIG. 5. Note that in the following explanation, same reference characters are assigned to structural components which are the same as the above-mentioned structural components, and explanation thereof will be omitted. A feature of the present embodiment is that the contents of the recording device 30 is updated also when printing of 1 page is finished.

That is, when printing is finished (S9: YES), the recorded contents of the recording device 30 is updated with the value that the remaining-amount counter 25 indicates (S31).

Figure 6:
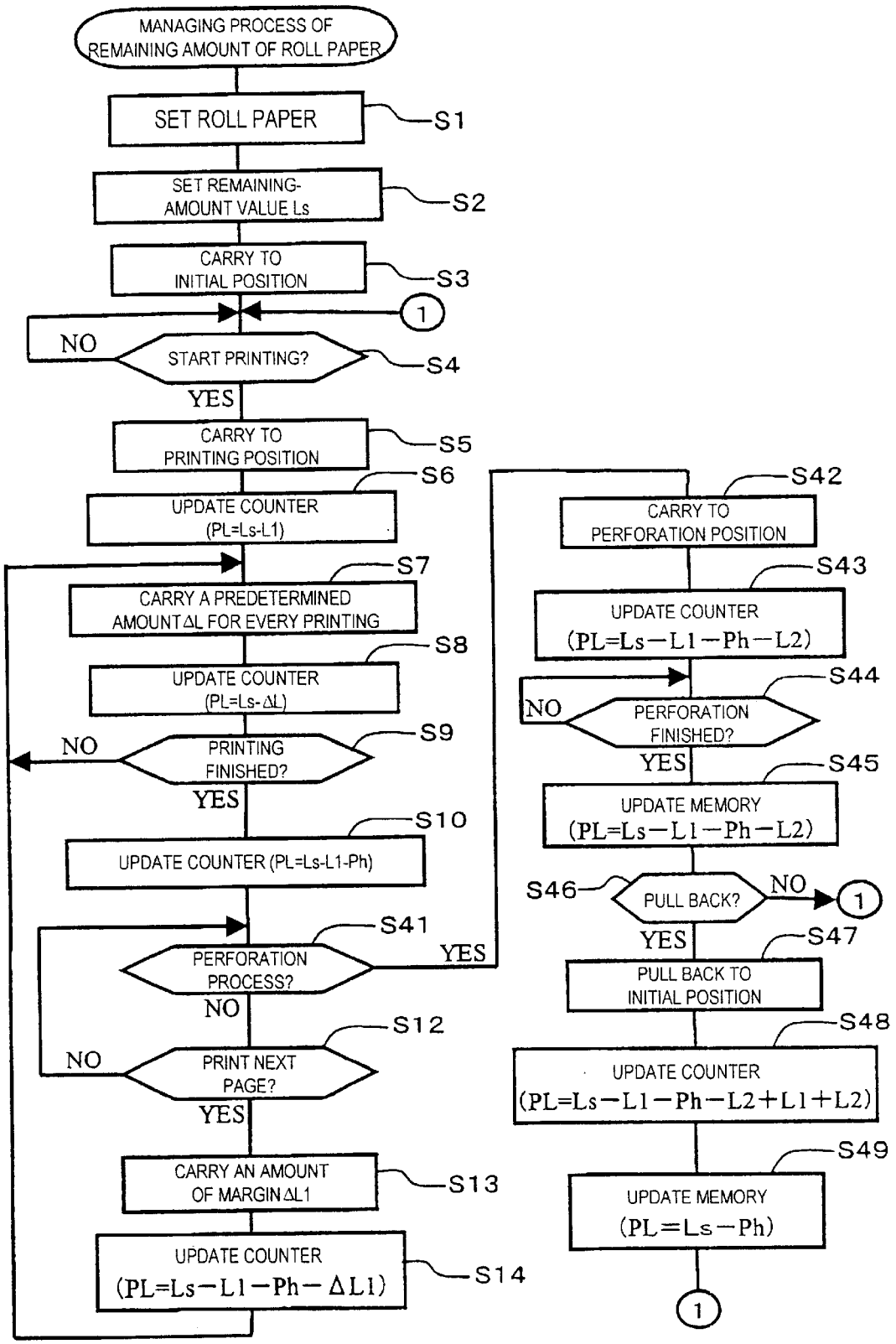
FIG. 6 is a flowchart showing a method for managing a remaining amount of roll paper according to a third embodiment of the present invention.

Next, a third embodiment of the present invention will be explained according to FIG. 6. A feature of the present embodiment is that a perforation process is adopted as the physical process indicating a break upon usage of the roll paper 1. A perforation process is to be implemented instead of the cutter 15.

When printing is finished (S9: YES), a decision is made whether to carry out a perforation process or not (S41). If perforations are to be made (S41: YES), the roll paper 1 is carried a distance L2 to a perforating position (S42). The remaining amount of roll paper that the remaining-amount counter 25 indicates is decreased by the carried amount L2 to the perforation-process position (S43).

Then, a decision is made whether the perforation process is finished or not (S44), an if perforations are made, the recorded contents of the recording device 30 is updated with the stored contents of the remaining-amount counter 25 (S45). Next, a decision is made whether or not to pull the roll paper 1 back to the initial position (S46), and if it is not pulled back (S46: NO), the procedure returns to the above-mentioned S4, and a standby state for printing will be performed.

On the other hand, for example, if the roll paper 1 is to be pulled back to the initial position such as when the user rips off the roll paper 1 at the position of the perforations (S46: YES), the roll paper 1 is pulled back to the initial position (S47). The value of the remaining-amount counter 25 increases in response to the pull-back (S48), and the recorded contents of the recording device 30 is updated with the recorded contents of the remaining-amount counter 25 of when the leading edge of the roll paper 1 returns to the initial position (S49).

Next, a fourth embodiment of the present invention will be explained according to FIG. 7. A feature of the present embodiment is that the reference printing position of the print head 12 is used as the initial position.

Figure 7A:
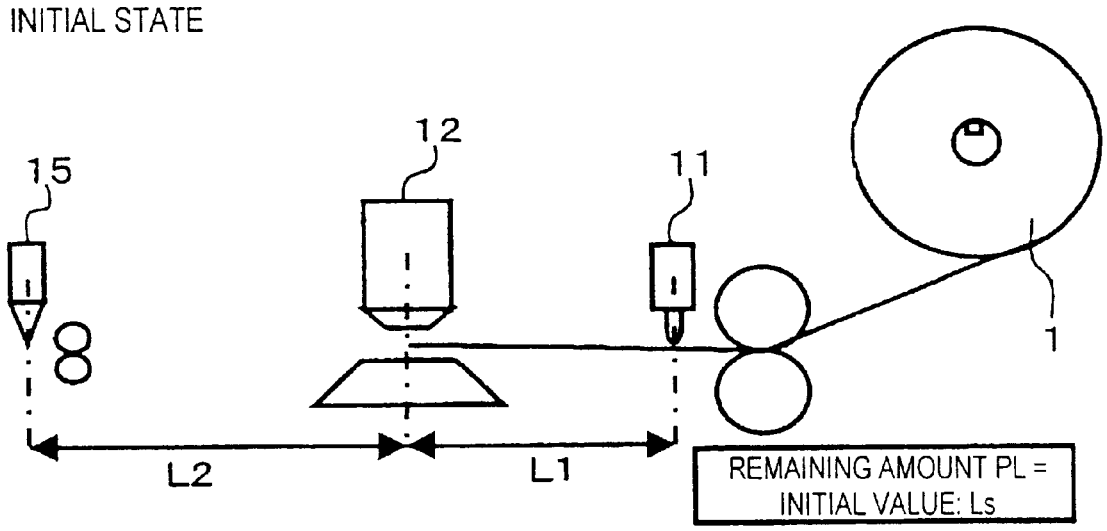
FIG. 7A, FIG. 7B and FIG. 7C are schematic diagrams according to a fourth embodiment of the present invention in which a reference printing position is used as the initial position.

That is, as shown in FIG. 7A, a reference position for carrying out printing with the print head 12 is used as the initial position. Therefore, the carried amount up to where the roll paper 1 is carried to the reference printing position will not be detected as the remaining amount of roll paper. When the leading edge of the roll paper 1 reaches the reference printing position, the remaining-amount value Ls recorded on the recording device 30 is set to the initial remaining-amount value 22. Instead, the remaining-amount value Ls recorded on the recording device 30 may be set to the initial remaining-amount value 22 at the time of setting the roll paper 1.

Figure 7B:
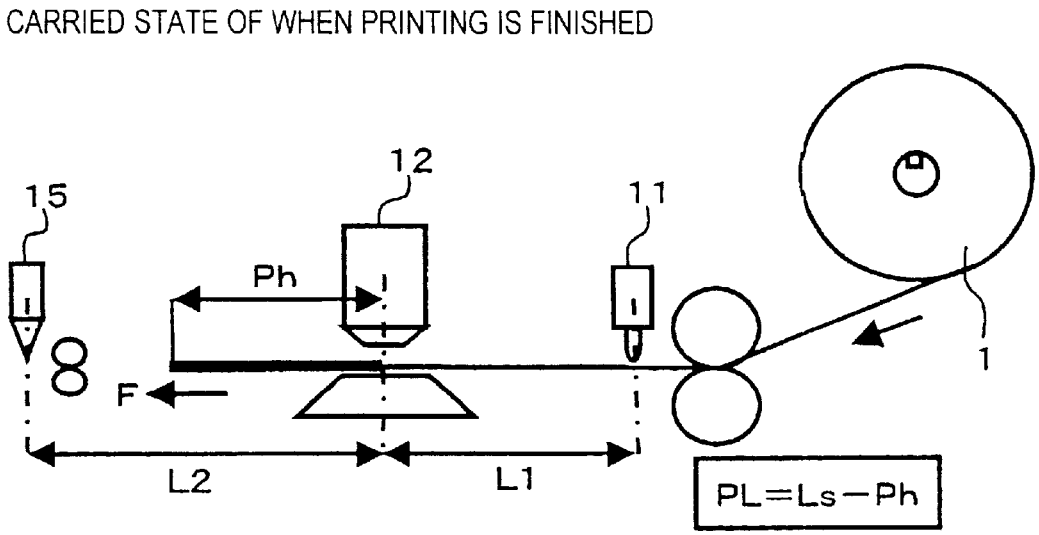
Figure 7C:
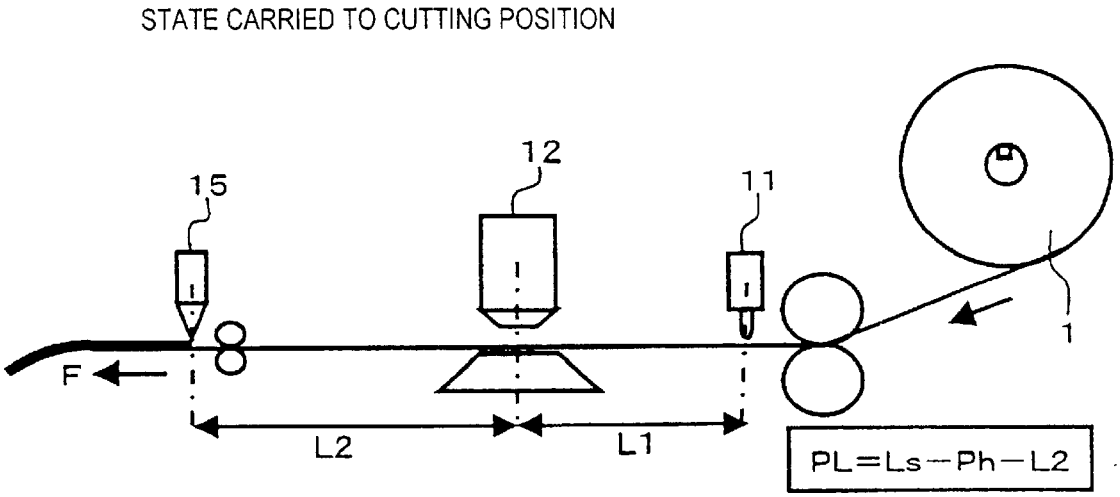

When printing is finished as shown in FIG. 7B and cutting is conducted by the cutter 15 as shown in FIG. 7C, the usage amount of the roll paper 1 is determined by this cutting. Then, as explained with FIG. 7A, the leading edge of the roll paper 1 is returned to the initial position.

Figure 8:
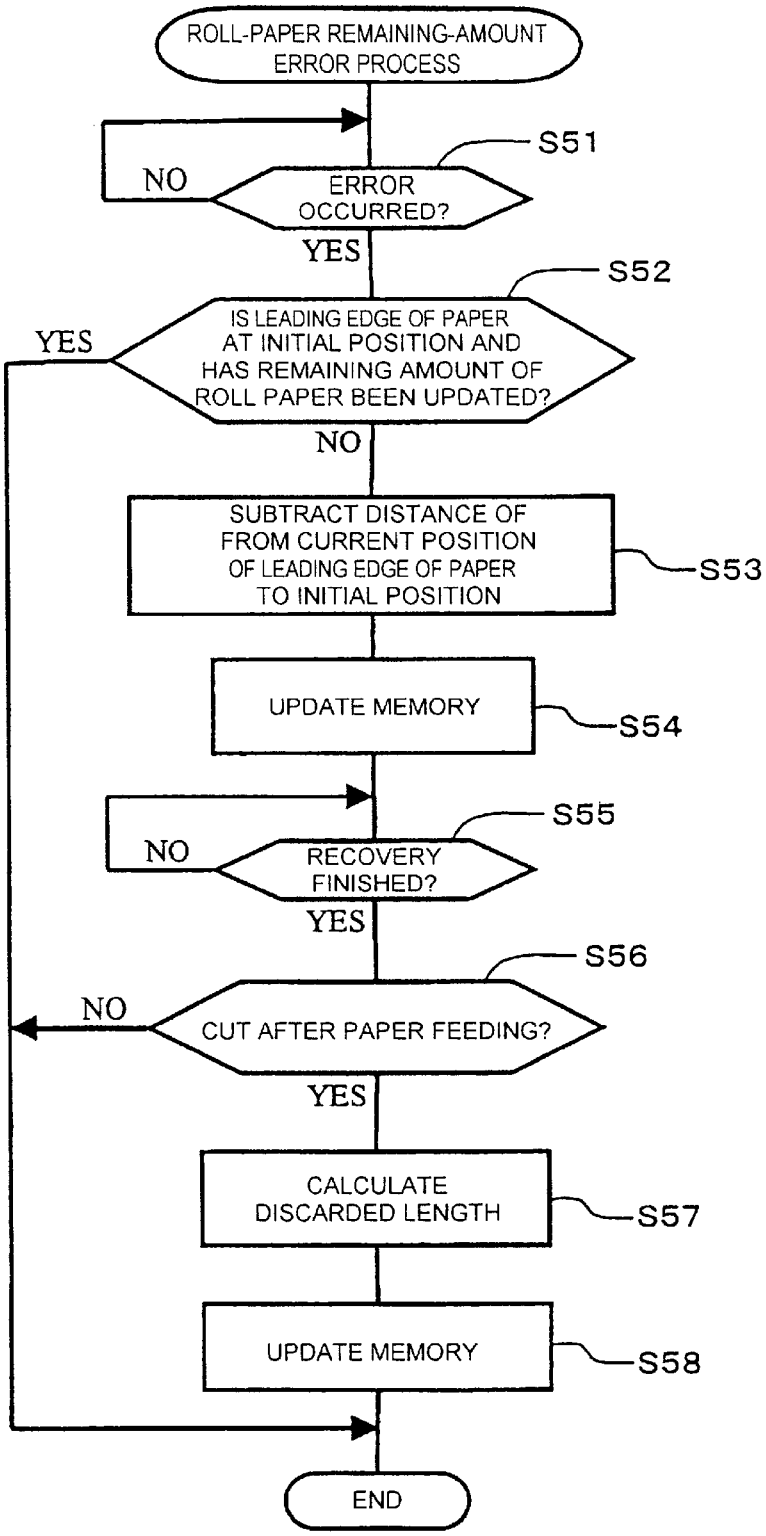
FIG. 8 is a flowchart showing a method for managing a remaining amount of roll paper upon occurrence of a printing error according to a fifth embodiment of the present invention.

Next, a fifth embodiment of the present invention will be explained according to FIG. 8. A feature of the present embodiment is that the remaining amount of roll paper recorded on the recording device 30 is to be updated when a printing error occurs.

Here, as for printing errors, it is possible to list, for example, a miss in a process of receiving print data (such as under-run error), jamming of paper, or the like. When a printing error occurs (S51: YES), a decision is made whether or not the leading edge of the roll paper 1 is already at the initial position and the data of the recording device 30 has already been updated with the latest remaining amount of roll paper (S52). For example, in a case where an error occurs during receiving of print data, this will be a printing error before starting of carrying of the roll paper 1. In this case, since there is no need to update the remaining amount of roll paper recorded on the recording device 30, the process is ended.

On the other hand, if carrying of the roll paper 1 has already started (S52: NO), the distance from the current position of the leading edge of the roll paper 1 to the initial value is calculated, the remaining amount of roll paper is decremented by this amount, and the contents of the recording device 30 is to be updated (S53, S54).

Further, a decision is made whether or not a process for recovering the error (such as removal of jammed paper and/or retrial of receiving data) has been carried out (S 55), and if a recovery process has been carried out, a decision is made whether or not the paper was fed and the roll paper 1 was cut (S56). That is, a decision is made whether or not the crinkled paper was removed and/or the partly-printed portion of paper was discarded. In case discarding was carried out by cut-off, the length having been discarded is calculated (S57), and the remaining amount of roll paper recorded on the recording device 30 is to be updated (S58).

Accordingly, it is possible to appropriately manage the remaining amount of the roll paper 1 even when an error occurs.

It is to be noted that the present invention is not limited to the above-mentioned respective embodiments. A person skilled in the art will be able to implement various alterations such as addition and/or deletion of structural components to/from the above-mentioned respective embodiments, or modifications thereto. For example, it is possible to adopt a folding process other than the cutting process and the perforation process.

Further, the present invention can be applied for managing amount information regarding an amount of a roll paper, such as a usage amount of roll paper, and not only for managing the remaining amount of roll paper. When applying the present invention for managing a usage amount of roll paper, in FIG. 1, the initial remaining-amount value 22 may be changed to an initial usage-amount value, the remaining-amount calculating section 21 may be changed to a usage-amount calculating section, and the remaining-amount counter 25 may be changed to a usage-amount counter. A roll-paper printing system applied for managing amount information regarding an amount of a roll paper comprises carry-amount detecting means, recording means, and updating means. The carry-amount detecting means detects a carried amount of the above-mentioned roll paper; the recording means records the amount information regarding the amount of the above-mentioned roll paper; and the updating means makes the above-mentioned amount information be recorded on the above-mentioned recording means according to the carry amount detected by the above-mentioned carry-amount detecting means. Further, the above-mentioned updating means makes the above-mentioned amount information be recorded on the above-mentioned recording means when a physical process indicating a break in roll-paper usage is carried out to the above-mentioned roll paper.

As explained above, according to the roll-paper printing system of the present embodiment, it is possible to appropriately manage the amount of roll paper without needless updating of amount information.

What is claimed is:

1. A roll-paper printing system conducting printing on a roll paper, comprising:

carry-amount detecting means which detects a carried amount of said roll paper;

remaining-amount detecting means which detects a remaining amount of roll paper based on said carried amount of roll paper and an initial remaining amount of said roll paper;

remaining-amount recording means provided on said roll paper for recording said remaining amount of roll paper; and remaining-amount updating means which causes said remaining amount of roll paper to be recorded on said remaining-amount recording means, when a physical process is conducted to said roll paper which indicates a break in roll-paper usage.

2. A roll-paper printing system according to claim 1, wherein said remaining-amount updating means makes said remaining amount of roll paper detected be recorded on said remaining-amount recording means when a leading edge of said roll paper is returned to a previously-set predetermined initial position after said physical process has been conducted.

3. A roll-paper printing system according to claim 2, wherein said predetermined initial position is a reference detecting position of a paper-detecting means for detecting a leading edge of paper.

4. A roll-paper printing system according to claim 2, wherein said predetermined initial position is a reference printing position of a printing means for conducting printing on said roll paper.

5. A roll-paper printing system according to claim 2, wherein said initial position is positioned upstream in a paper-carrying direction from a position where said physical process is conducted.

6. A roll-paper printing system according to claim 1, wherein said remaining-amount updating means makes said remaining amount of roll paper detected be recorded on said remaining-amount recording means before said physical process is conducted in case a printing error occurs.

7. A roll-paper printing system according to claim 1, wherein said physical process is either one of: a cutting process of cutting said roll paper at a predetermined position; a perforation process of making perforations at a predetermined position in said roll paper; or a folding process of putting a fold at a predetermined position in said roll paper.

8. A method for managing a remaining amount of roll paper in order to make said remaining amount of roll paper be recorded on a remaining-amount recording means, comprising:

detecting a carried amount according to carrying of said roll paper from when a leading edge of said roll paper passes a predetermined initial position;

after a physical process for indicating a break in roll-paper usage has been conducted to said roll paper, making a remaining amount of roll paper be determined based on said carried amount when said leading edge of the roll paper is returned to said initial position; and making said determined remaining amount of roll paper be recorded on said remaining-amount recording means.

9. A recording medium on which a roll-paper remaining-amount management program for making a remaining amount of roll paper be recorded on a remaining-amount recording means is recorded readable to a computer, wherein said roll-paper management program makes a computer carry out the following steps comprising:

a step of detecting a remaining amount of roll paper based on a carried amount of roll paper detected according to carrying of said roll paper and an initial remaining amount of said roll paper;

a step of detecting whether or not a physical process has been conducted to said roll paper for indicating a break in roll paper usage; and a step of making recorded contents of said remaining-amount recording means be updated with a value of said remaining amount of roll paper detected when said physical process is conducted to said roll paper.

10. A roll-paper printing system conducting printing on a roll paper, comprising:

carry-amount detecting means which detects a carried amount of said roll paper;

remaining-amount detecting means which detects a remaining amount of roll paper based on said carried amount of roll paper detected and an initial remaining amount of said roll paper;

remaining-amount recording means for recording said remaining amount of roll paper detected; and remaining-amount updating means which makes said remaining amount of roll paper detected by said remaining-amount detecting means be recorded on said remaining-amount recording means, said remaining-amount updating means making said remaining amount of roll paper be updated at a predetermined timing, and not conducting updating of said remaining amount of roll paper if the roll of paper has not reached an initial position when a printing error has occurred.

11. A roll paper printing system comprising a roll paper with a memory having a remaining-amount recording means for recording a remaining-amount value of the roll paper itself, wherein, when a physical process for indicating a break in roll-paper usage is conducted by a roll-paper printing apparatus, said remaining-amount value recorded on said remaining-amount recording means is updated by a remaining-amount updating means provided on said roll-paper printing apparatus.

12. A roll-paper printing system conducting printing on a roll paper, comprising:

carry-amount detecting means for detecting a carried amount of said roll paper;

recording means for recording amount information regarding an amount of said roll paper; and updating means which makes said amount information to be recorded on said recording means based on the carried amount detected by said carry-amount detecting means, when a physical process is conducted to said roll paper for indicating a break in roll paper usage.

13. A roll-paper printing system according to claim 12, wherein said updating means makes said amount information be recorded on said recording means when a leading edge of said roll paper is returned to a previously-set predetermined initial position after said physical process has been conducted.

14. A roll-paper printing system according to claim 13, wherein said predetermined initial position is a reference detecting position of a paper-detecting means for detecting a leading edge of paper.

15. A roll-paper printing system according to claim 13, wherein said predetermined initial position is a reference printing position of a printing means for conducting printing on said roll paper.

16. A roll-paper printing system according to claim 13, wherein said initial position is positioned upstream in a paper-carrying direction from a position where said physical process is conducted.

17. A roll-paper printing system according to claim 12, wherein said updating means makes said amount information be recorded on said recording means before said physical process is conducted in case a printing error occurs.

18. A roll-paper printing system according to claim 12, wherein said physical process is either one of: a cutting process of cutting said roll paper at a predetermined position; a perforation process of making perforations at a predetermined position in said roll paper; or a folding process of putting a fold at a predetermined position in said roll paper.

19. A roll-paper printing system according to claim 12, wherein said amount information is a usage amount of said roll paper.

20. A roll-paper printing system according to claim 12, wherein said amount information is a remaining amount of said roll paper.

21. A roll-paper printing system according to claim 20, wherein, said system comprises a remaining-amount detecting means which detects a remaining amount of roll paper based on a carried amount of roll paper detected by said carry-amount U detecting means and an initial remaining amount of said roll paper, said updating means makes a remaining amount of roll paper detected by said remaining-amount detecting means be recorded on said recording means, and said updating means makes said remaining amount detected by said remaining-amount detecting means be recorded on said recording means when a physical process for indicating a break in roll-paper usage is conducted to said roll paper.

22. A roll-paper printing system according to claim 12, wherein said recording means is provided on said roll paper.

23. A roll-paper printing system conducting printing on a roll paper, comprising:

a carry-amount detector which detects a carried amount of said roll paper;

a remaining-amount detector which detects a remaining amount of roll paper based on said carried amount of roll paper and an initial remaining amount of said roll paper;

a memory provided on said roll paper for recording said remaining amount of roll paper; and a memory-accessing section which causes said remaining amount of roll paper to be recorded on said memory, when a physical process is conducted to said roll paper which indicates a break in roll-paper usage.

* * * * *